US009429368B2

(12) United States Patent
Hong et al.

(10) Patent No.: US 9,429,368 B2
(45) Date of Patent: Aug. 30, 2016

(54) TEMPERATURE-SENSING PIEZOELECTRIC DISPENSER

(71) Applicant: PROTEC CO., LTD., Incheon (KR)

(72) Inventors: Seung Min Hong, Incheon (KR); Hansung Lee, Gyeonggi-Do (KR); Yong Hun Lee, Incheon (KR); Min Sun Kim, Incheon (KR)

(73) Assignee: PROTEC CO., LTD., Incheon (KR)

( * ) Notice: Subject to any disclaimer, the term of this patent is extended or adjusted under 35 U.S.C. 154(b) by 0 days.

(21) Appl. No.: 14/754,722

(22) Filed: Jun. 30, 2015

(65) Prior Publication Data

US 2015/0300748 A1 Oct. 22, 2015

Related U.S. Application Data

(63) Continuation of application No. PCT/KR2014/007472, filed on Aug. 12, 2004.

(30) Foreign Application Priority Data

Aug. 14, 2013 (KR) ..... 10-2013-0096739

(51) Int. Cl.

| | |
|---|---|
| ***F28D 15/00*** | (2006.01) |
| ***F04B 17/00*** | (2006.01) |
| ***F28F 7/00*** | (2006.01) |
| ***F04B 43/04*** | (2006.01) |
| ***F04B 13/00*** | (2006.01) |
| ***B05C 5/02*** | (2006.01) |

(52) U.S. Cl.

CPC ..... *F28D 15/00* (2013.01); *B05C 5/0225* (2013.01); *F04B 13/00* (2013.01); *F04B 17/003* (2013.01); *F04B 43/04* (2013.01); *F28F 7/00* (2013.01)

(58) Field of Classification Search

CPC ..... B65D 83/265; B67D 2210/00099; B67D 2210/00102; B67D 2210/00104; F04B 13/00; F04B 17/003; F04B 43/04; F04B 43/043; F04B 43/046; F16K 31/004; F28D 15/00; F28F 7/00; H01L 29/84; H01L 41/00; B05C 5/0225

USPC ..... 222/54

See application file for complete search history.

(56) References Cited

U.S. PATENT DOCUMENTS

| | | | | |
|---|---|---|---|---|
| 5,024,587 A * | 6/1991 | Maurer | F04B 7/045 | 222/333 |
| 7,762,088 B2 * | 7/2010 | Fiske | B05C 5/001 | 62/3.64 |
| 8,590,743 B2 * | 11/2013 | Beland | B65D 83/205 | 222/1 |

FOREIGN PATENT DOCUMENTS

| | | | |
|---|---|---|---|
| KR | 10-1999-0080511 | 11/1999 | |
| KR | 10-0482697 | 4/2005 | |
| KR | 10-2005-0079557 | 8/2005 | |
| KR | 10-1150139 | 6/2012 | |
| KR | 101150139 B1 * | 6/2012 | B05B 17/06 |

* cited by examiner

*Primary Examiner* — Nicholas J Weiss
(74) *Attorney, Agent, or Firm* — Jianq Chyun IP Office

(57) ABSTRACT

Provided is a temperature-sensing piezoelectric dispenser, and more particularly, to a dispenser including a piezoelectric pump dispensing a liquid by using a piezoelectric element as an actuator. According to the temperature-sensing piezoelectric dispenser, a temperature of a piezoelectric actuator is measured and the piezoelectric actuator is cooled based on the measured temperature, thereby accurately controlling a liquid discharged according to an operation of the piezoelectric actuator.

8 Claims, 10 Drawing Sheets

TEMPERATURE-SENSING PIEZOELECTRIC DISPENSER

CROSS-REFERENCE TO RELATED APPLICATIONS

This application is a Continuation of PCT International Application No. PCT/KR2014/007472 filed on Aug. 12, 2014, which claims priority under 35 U.S.C §119(a) to Korean Patent Application No. 10-2013-0096739 filed on Aug. 14, 2013. Each of the above application(s) is hereby expressly incorporated by reference, in its entirety, into the present application.

TECHNICAL FIELD

The inventive concept relates to a temperature-sensing piezoelectric dispenser, and more particularly, to a dispenser including a piezoelectric pump dispensing a liquid by using a piezoelectric element as an actuator.

BACKGROUND ART

A dispenser supplying a predetermined amount of liquid that is in liquid form, such as water, oil, or resin is used in various fields such as in a semiconductor process or in the medical field.

Particularly in a semiconductor process, a dispenser is frequently used in an underfill process to fill a package of a semiconductor device with a resin. In a process of manufacturing a light emitting diode (LED) device, a dispenser is used in a process of coating a LED chip of the LED device with a phosphorescent liquid in which a phosphorescent material and a resin are mixed.

The dispenser as described above includes, as a core element, a pump that receives a liquid and dispenses a fixed amount of the liquid to an exact position.

Various pumps structures such as a screw pump or a linear pump are available. Recently, a piezoelectric pump that uses a piezoelectric element as an actuator has been developed and used in a semiconductor process or the like to perform a dispensing operation at a high speed.

KR 2005-0079557 (published on Aug. 10, 2005) discloses a piezoelectric pump structure comprising a plurality of piezoelectric actuators, on which a piezoelectric element is attached, and which are sequentially operated in connection with one another at different displacement differences to pump a fluid.

A piezoelectric actuator used in a piezoelectric pump is usually formed of a ceramic material. Most piezoelectric actuators including such ceramic piezoelectric actuators generate heat when operating according to an applied voltage. When a temperature of the piezoelectric actuator increases due to heat generated in the piezoelectric actuator, dynamic characteristics of the piezoelectric actuator are changed, and the lifetime of the piezoelectric actuator is also reduced.

Thus, a piezoelectric pump or a piezoelectric dispenser having a structure capable of preventing an increase in a temperature of a piezoelectric actuator is required.

DETAILED DESCRIPTION OF THE INVENTIVE CONCEPT

Technical Problem

The inventive concept provides a temperature-sensing piezoelectric dispenser capable of sensing a temperature generated in a piezoelectric actuator and cooling the piezoelectric actuator based on the sensed temperature.

Technical Solution

According to an aspect of the inventive concept, there is provided a temperature-sensing piezoelectric dispenser comprising: a pump body comprising a cooling line, through which a cooling fluid flows; a lever that is rotatably installed with respect to a hinge axis installed in the pump body; a piezoelectric actuator installed in the pump body and having a tip portion that is contactable to the lever as a length of the piezoelectric actuator is increased when a voltage is applied to the piezoelectric actuator to press and rotate the lever with respect to the hinge axis; a valve rod that is liftably connected to the lever according to rotation of the lever; a valve body comprising a storing unit, into which a tip portion of the valve rod is inserted and in which a liquid is stored, an inlet, through which the liquid flows into the storing unit, and a nozzle, through which the liquid of the storing unit is discharged according to advance and retreat of the valve rod with respect to the storing unit; a temperature sensor installed in one of the piezoelectric actuator and the pump body to measure a temperature; a cooling pump for supplying a cooling fluid to the cooling line of the pump body; and a control unit for operating the piezoelectric actuator and receiving the temperature sensed by using the temperature sensor to operate the cooling pump.

Advantageous Effects

According to the temperature-sensing piezoelectric dispenser according to the inventive concept, a temperature of a piezoelectric actuator is measured and the piezoelectric actuator is cooled based on the measured temperature, thereby accurately controlling a liquid discharged according to an operation of the piezoelectric actuator.

BEST MODE

Hereinafter, a temperature-sensing piezoelectric dispenser according to the inventive concept will be described more fully with reference to the accompanying drawings.

Figure 1:
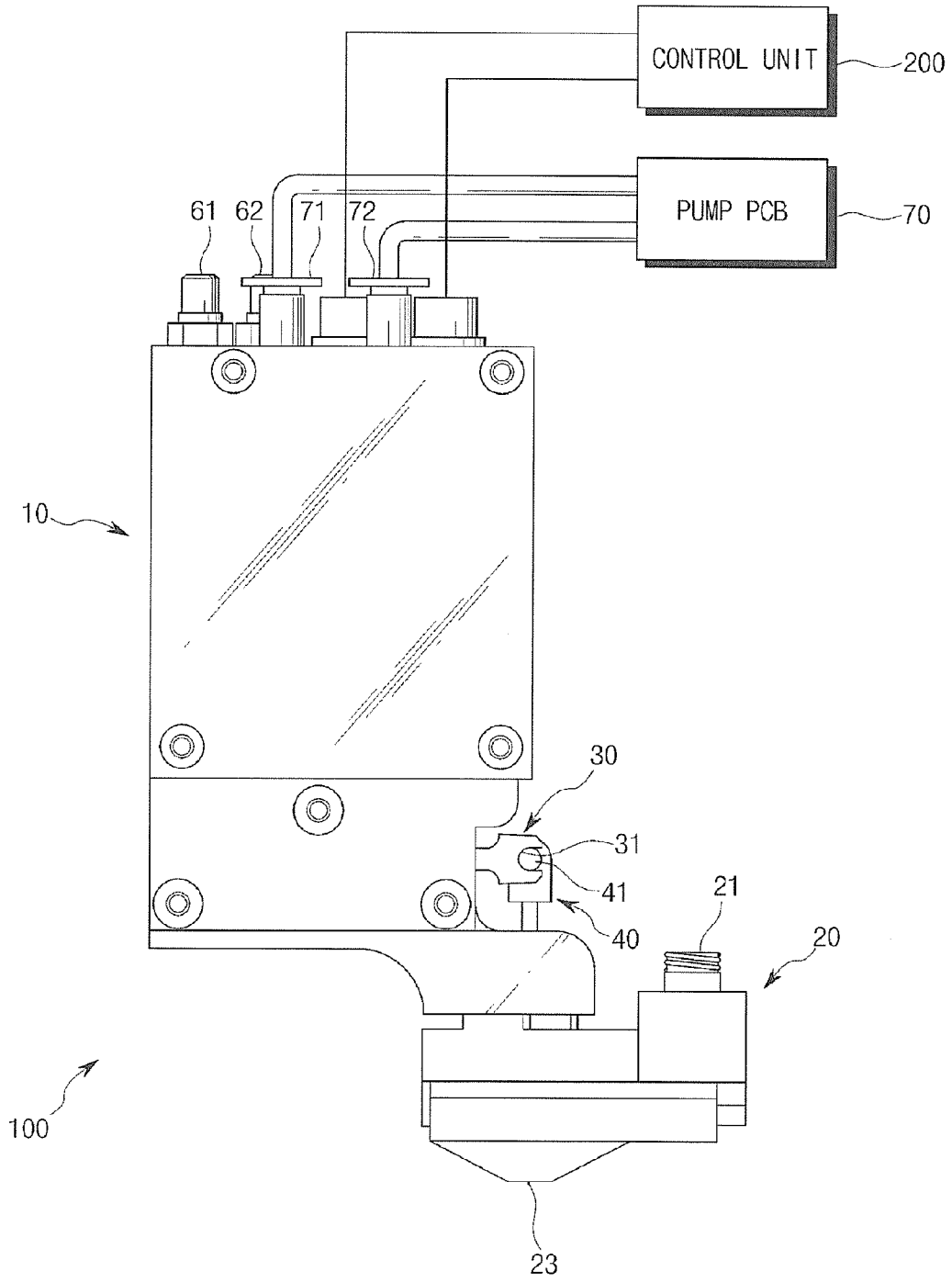
FIG. 1 is a front view of a piezoelectric pump of a temperature-sensing piezoelectric dispenser according to an embodiment of the inventive concept.
Figure 2:
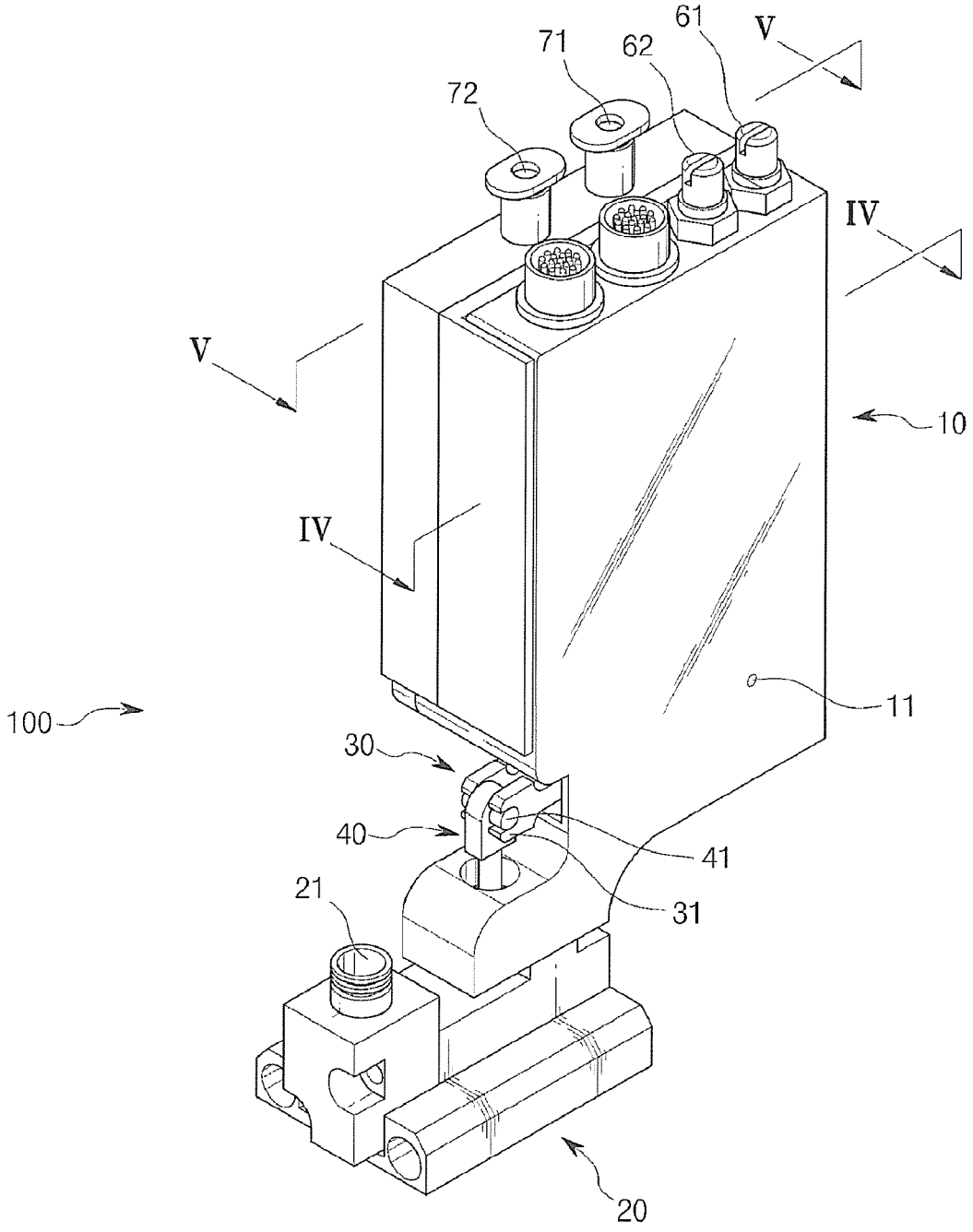
FIG. 2 is a perspective view of the piezoelectric pump illustrated in FIG. 1.
Figure 3:
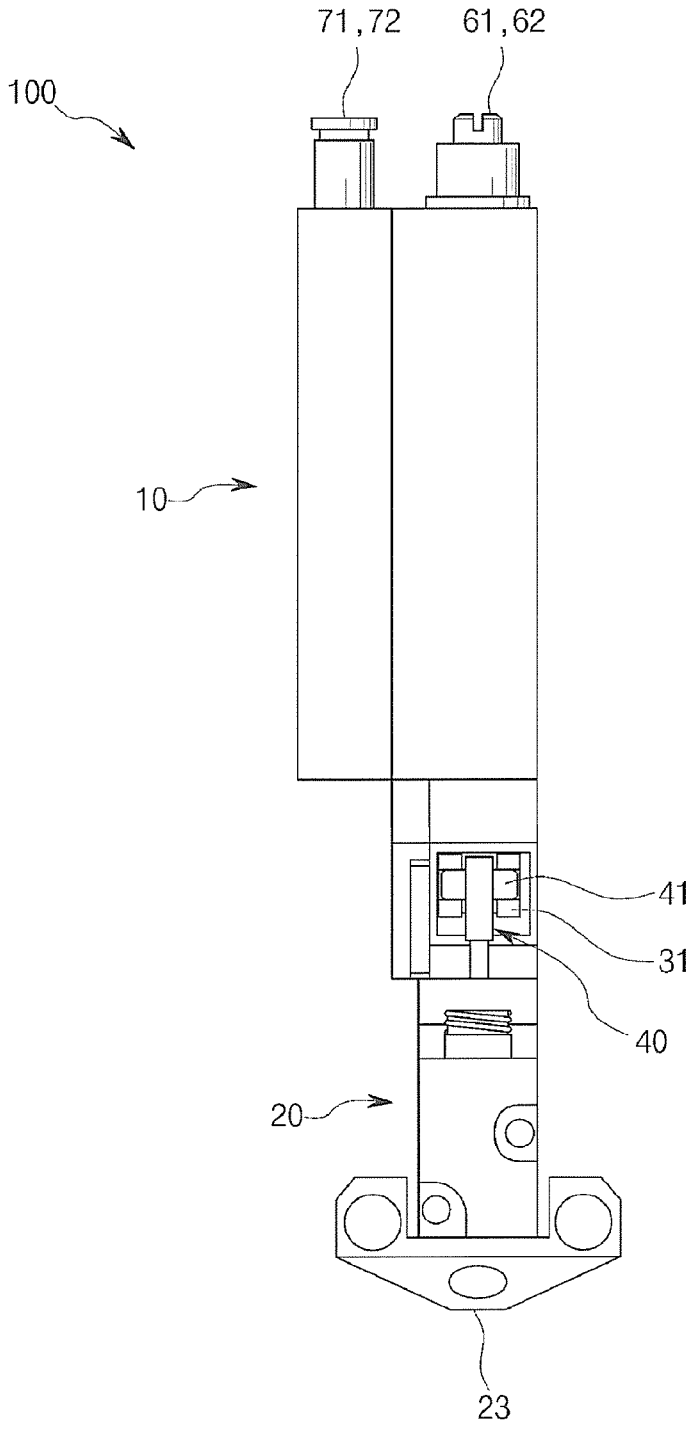
FIG. 3 is a side view of the piezoelectric pump illustrated in FIG. 1.

FIG. 1 is a front view of a piezoelectric pump of a temperature-sensing piezoelectric dispenser according to an embodiment of the inventive concept. FIG. 2 is a perspective view of the piezoelectric pump illustrated in FIG. 1. FIG. 3 is a side view of the piezoelectric pump illustrated in FIG. 1.

Referring to FIGS. 1 through 3, the temperature-sensing piezoelectric dispenser according to the present embodiment includes a piezoelectric pump 100, a control unit 200, and a cooling pump 70. The piezoelectric pump 100 includes a pump body 10 and a valve body 20.

The pump body 10 and the valve body 20 are detachably coupled to each other by using a bolt as illustrated in FIG. 1.

A hinge axis 11 is mounted in the pump body 10, and the lever 30 extending in a horizontal direction is rotatably installed with respect to the hinge axis 11. The valve rod 40 extending in a vertical direction is inserted into the valve body 20. The lever 30 and the valve rod 40 are connected to each other, and when the lever 30 rotates with respect to the hinge axis 11, the valve rod 40 is lifted up or lowered down.

A first piezoelectric actuator 51 and a second piezoelectric actuator 52 are installed in the pump body 10 and rotate the lever 30 with respect to the hinge axis 11. The first piezoelectric actuator 51 and the second piezoelectric actuator 52 are formed of piezoelectric elements. That is, the first piezoelectric actuator 51 and the second piezoelectric actuator 52 are formed of piezoelectric elements whose length increases or decreases according to a potential of a voltage applied to the piezoelectric elements. Here, an embodiment will be described, in which multi-stack piezoelectric actuators formed by stacking multiple piezoelectric elements are configured as the first piezoelectric actuator 51 and the second piezoelectric actuator 52.

Figure 4:
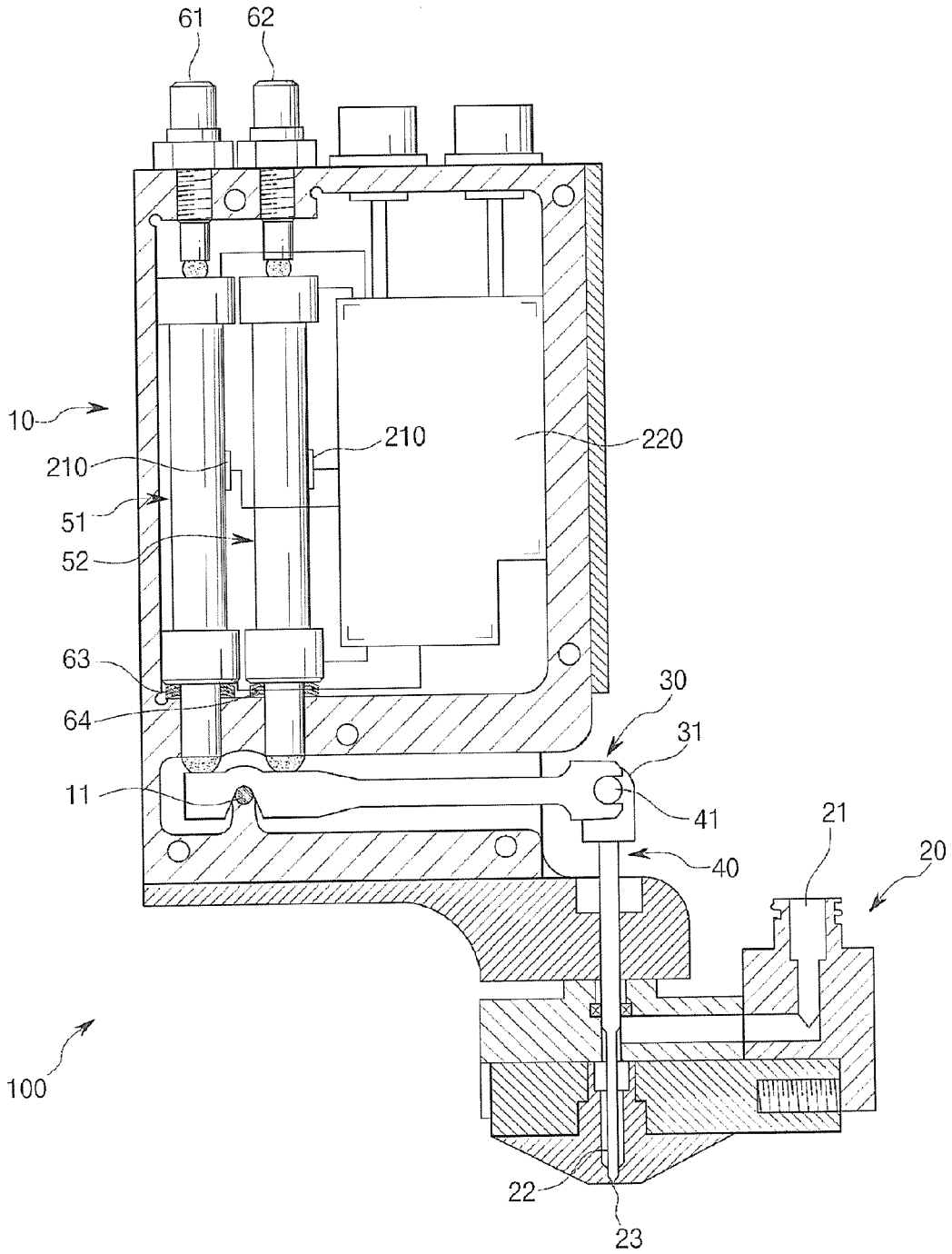
FIG. 4 is a cross-sectional view of the piezoelectric pump illustrated in FIG. 2 cut along a line IV-IV.

As illustrated in FIG. 4, the first piezoelectric actuator 51 and the second piezoelectric actuator 52 arranged in parallel to each other in a vertical direction are installed in the pump body 10. The first piezoelectric actuator 51 and the second piezoelectric actuator 52 are disposed with the hinge axis 11 therebetween and such that lower end portions thereof respectively contact a top surface of the lever 30. When a voltage is applied to the first piezoelectric actuator 51 to increase a length of the first piezoelectric actuator 51, the lever 30 rotates counter-clockwise with respect to FIG. 4, and when a voltage is applied to the second piezoelectric actuator 52 to increase a length of the second piezoelectric actuator 52, the lever 30 rotates clockwise with respect to FIG. 4.

A first adjustment unit 61 and a second adjustment unit 2 that are respectively disposed on upper ends of the first piezoelectric actuator 51 and the second piezoelectric actuator 52 are installed in the pump body 10. In the present embodiment, the first adjustment unit 61 and the second adjustment unit 62 which are in the form of set screws are screw-coupled to the pump body 10 while respectively contacting tip portions of the first piezoelectric actuator 51 and the second piezoelectric actuator 52. The first adjustment unit 61 adjusts a position of the first piezoelectric actuator 51 with respect to the lever 30 and the pump body 10, and the second adjustment unit 62 adjusts a position of the second piezoelectric actuator 52 with respect to the lever 30 and the pump body 10. When the first adjustment unit 61 is tightened to move the first piezoelectric actuator 51 forward with respect to the pump body 10, the first piezoelectric actuator 51 may be lowered to be close to or in close contact with the lever 30. The second adjustment unit 62 is also operated in the same manner as the first adjustment unit 61.

A first returning unit 63 and a second returning unit 64 disposed respectively below the first piezoelectric actuator 51 and the second piezoelectric actuator 52 are installed in the pump body 10. The first returning unit 63 applies a force to the first piezoelectric actuator 51 in a direction opposite to a direction in which the first piezoelectric actuator 51 presses the lever 30. Likewise, the second returning unit 64 applies a force to the second piezoelectric actuator 52 in a direction opposite to a direction in which the second piezoelectric actuator 52 presses the lever 30. The first returning unit 63 and the second returning unit 64 may be springs that respectively provide an elastic force under the first piezoelectric actuator 51 and the second piezoelectric actuator 52 in a direction in which the first piezoelectric actuator 51 and the second piezoelectric actuator 52 are contracted with respect to the pump body 10, or may be fluid ducts. According to the present embodiment, springs 63 and 64 which are plate springs are installed in the pump body 10 to transmit an elastic force to the first piezoelectric actuator 51 and the second piezoelectric actuator 52. If a pneumatic pressure or a fluid pressure is used unlike the present embodiment, a fluid duct may be used to transmit a pneumatic pressure or a fluid pressure to the first piezoelectric actuator 51 and the second piezoelectric actuator 52 to thereby transmit a force in a direction in which the first piezoelectric actuator 51 and the second piezoelectric actuator 52 are returned to an original position.

Referring to FIG. 4, a temperature sensor 210 is installed on each of the first piezoelectric actuator 51 and the second piezoelectric actuator 52. The temperature sensor 210 may be installed on the piezoelectric actuators 51 and 52 or in the pump body 10. Here, an embodiment in which the temperature sensor 210 is installed on the piezoelectric actuators 51 and 52 will be described. The temperature sensor 210 measures a temperature of the piezoelectric actuators 51 and 52 and transmits the temperature to the control unit 200. A pump PCB 200 is installed in the pump body 10, and the pump PCB 220 receives a control signal from the control unit 200 and transmits the control signal to the piezoelectric actuators 51 and 52. The temperature measured by using the temperature sensor 210 is transmitted to the control unit 200 via the pump PCB 200.

The control unit 200 is disposed outside the piezoelectric pump 100 and is electrically connected to the piezoelectric pump 100 to control an operation of the piezoelectric pump 100. That is, the control unit 200 is electrically connected to the first piezoelectric actuator 51 and the second piezoelectric actuator 52 of the piezoelectric pump 100 to supply power thereto to thereby control the operation of the piezoelectric actuators 51 and 52. When the piezoelectric pump 100 is used by installing the same in a horizontal transporting unit that transports the piezoelectric pump 100 in forward and backward directions and to the left and the right, the control unit 200 controls an operation of the horizontal transporting unit. That is, according to the temperature-sensing piezoelectric dispenser according to the inventive concept, the control unit 200 may use the horizontal transporting unit to move the piezoelectric pump 100 forward or backward or to the left or the right to thereby dispense a liquid to products disposed below the piezoelectric pump 100. The control unit 200 may also adjust a movement speed of the piezoelectric pump 100 by controlling the horizontal transporting unit.

Figure 5:
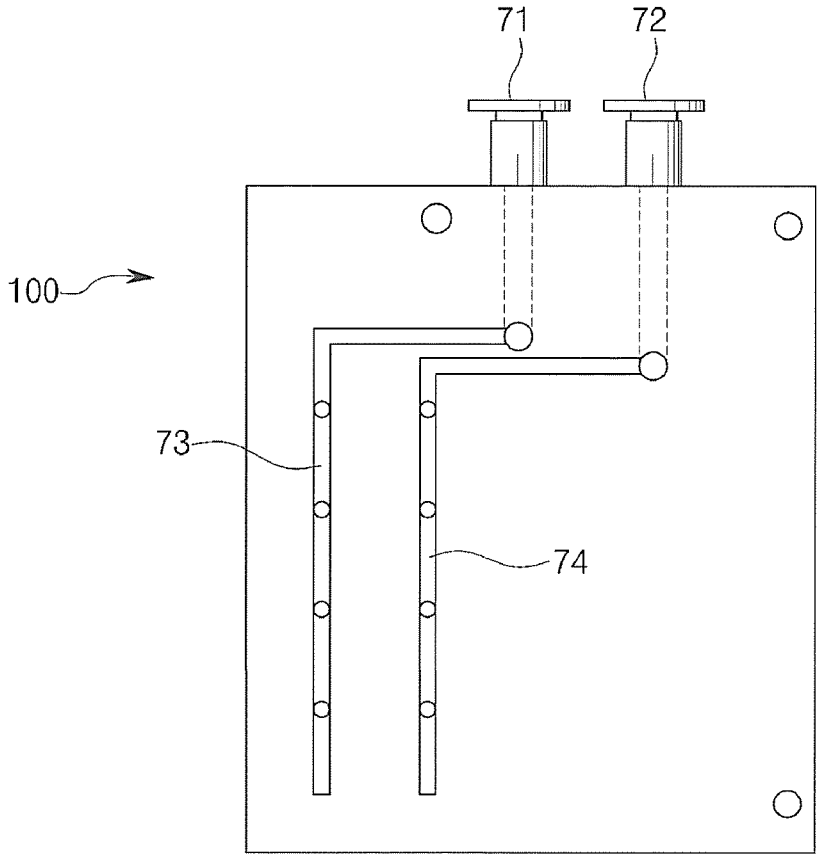
FIG. 5 is a cross-sectional view of the piezoelectric pump illustrated in FIG. 2 cut along a line V-V.

Cooling lines 71, 72, 73, and 74 through which a cooling fluid may flow are formed in the pump body 10 as illustrated in FIG. 5. According to the present embodiment, air is supplied to the pump body 10 through the cooling lines 71, 72, 73, and 74. The cooling lines 71, 72, 73, and 74 formed in the pump body 10 are formed to discharge the air supplied to the cooling pump 70 by allowing the air to pass through space in which the piezoelectric actuators 51 and 52 are installed.

The cooling pump 70 is connected to the cooling lines 71, 72, 73, and 74 of the pump body 10 to supply air. The cooling pump 70 is controlled by being connected to the control unit 200. When a temperature sensed by the temperature sensor 210 is increased, the control unit 200 may operate the cooling pump 70 to increase a flow of air supplied through the cooling lines 71, 72, 73, and 74, thereby cooling the piezoelectric actuators 51 and 52. On the contrary, when a temperature of the piezoelectric actuators 51 and 52 sensed by the temperature sensor 210 is decreased, the control unit 200 controls the piezoelectric actuators 51 and 52 such that a flow of air supplied through the cooling lines 71, 72, 73, and 74 is reduced. The air supplied through the cooling lines 71, 72, 73, and 74 from the cooling pump 70 contacts the piezoelectric actuators 51 and 52 to absorb heat, and then is discharged to the outside through an outlet formed in the pump body 10.

The valve body 20 includes a storing unit 22, an inlet 21, and a nozzle 23. The storing unit 22 is in the form of a container having an opened top portion, and the valve rod 40 is inserted into the storing unit 22 so as to tightly close the top portion of the storing unit 22. The inlet 21 is connected to the storing unit 22. A liquid supplied from the outside is transferred to the storing unit 22 through the inlet 21.

The valve rod 40 connected to the lever 30 is lifted with respect to the storing unit 22 according to rotation of the lever 30. As the valve rod 40 is lifted and then lowered to approach the nozzle 23 disposed under the valve rod 40, the liquid inside the storing unit 22 is pressurized and is dispensed to the outside through the nozzle 23.

The lever 30 and the valve rod 40 may be connected using various methods. According to the present embodiment, the lever 30 and the valve rod 40 are connected to each other in a manner as illustrated in FIGS. 1 and 2. An engaging groove 31 that is opened in a horizontal direction is formed at a tip portion of the lever 30. That is, the engaging groove 31 of the lever 30 has a C-shape. An engaging rod 41 is formed on an upper end portion of the valve rod 40. The engaging rod 41 is inserted into the engaging groove 31 of the lever 30 to be rotatably connected to the lever 30. That is, rotation of the lever 30 may be converted to elevation of the valve rod 40. As the engaging groove 31 is formed to be opened in a horizontal direction, the engaging rod 41 may be moved in a horizontal direction with respect to the engaging groove 31 to thereby detach the engaging groove 31 and the engaging rod 41 from each other. As the engaging groove 31 is formed in a horizontal direction, even if the engaging groove 31 is lifted according to rotation of the lever 30, the engaging rod 41 is lifted or lowered with respect to the valve body 20 without being detached from the engaging groove 31. When the lever 30 and the valve rod 40 are to be separated from each other, they may be easily separated by moving the engaging rod 41 in a horizontal direction with respect to the engaging groove 31.

As described above, when referring to FIGS. 2 and 5, the cooling lines 71, 72, 73, and 74 are formed in the pump body 10. That is, cooling paths through which a cooling fluid may flow via the pump body 10 are formed in the pump body 10. By allowing a gas or liquid of a relatively low temperature to flow through the cooling paths as described above, heat generated in the first piezoelectric actuator 51 and the second piezoelectric actuator 52 is discharged to the outside.

Hereinafter, an operation of the temperature-sensing piezoelectric dispenser according to the present embodiment configured as described above will be described.

Figure 7:
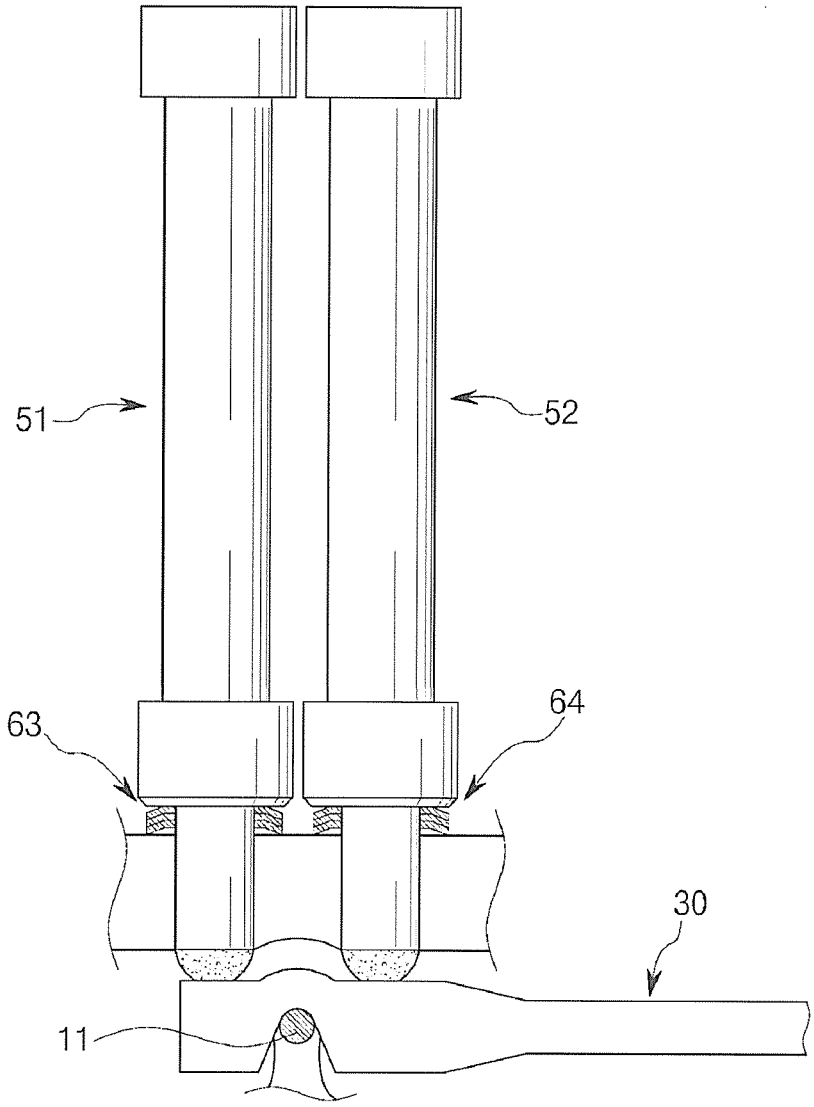
FIGS. 7 through 9 are schematic views for explaining an operation of the piezoelectric pump of the temperature-sensing piezoelectric dispenser illustrated in FIG. 1.

First, while the pump body 10, the valve body 20, and the other elements are assembled as shown in FIG. 1, a voltage is applied to the first piezoelectric actuator 51 and the second piezoelectric actuator 52. A voltage of 50% with respect to a voltage that is to be applied to the second piezoelectric actuator 52 in order to lower the valve rod 40 to dispense a liquid through the nozzle 23 is applied to each of the first piezoelectric actuator 51 and the second piezoelectric actuator 52. As illustrated in FIG. 7, as the first piezoelectric actuator 51 and the second piezoelectric actuator 52 are extended by the same length, each of lower end portions thereof is in contact with the lever 30. In this state, the first adjustment unit 61 and the second adjustment unit 62 are respectively used to adjust positions of the first piezoelectric actuator 51 and the second piezoelectric actuator 52. The first piezoelectric actuator 51 and the second piezoelectric actuator 52 are respectively moved forward or backward by rotating bolts 61 and 62 so that the lever 30 is in a horizontal state. Here, when the bolts 61 and 62 are rotated to move the first piezoelectric actuator 51 or the second piezoelectric actuator 52 backward, the first piezoelectric actuator 51 or the second piezoelectric actuator 52 is pushed and lifted due to an operation of the first returning unit 63 and the second returning unit 64.

Initial positions of the first piezoelectric actuator 51 and the second piezoelectric actuator 52 for dispensing are set in the above-described manner.

In this state, a liquid is supplied to the storing unit 22 through the inlet 21 at a predetermined pressure.

In this state, a dispensing process of the liquid is started.

Figure 8:
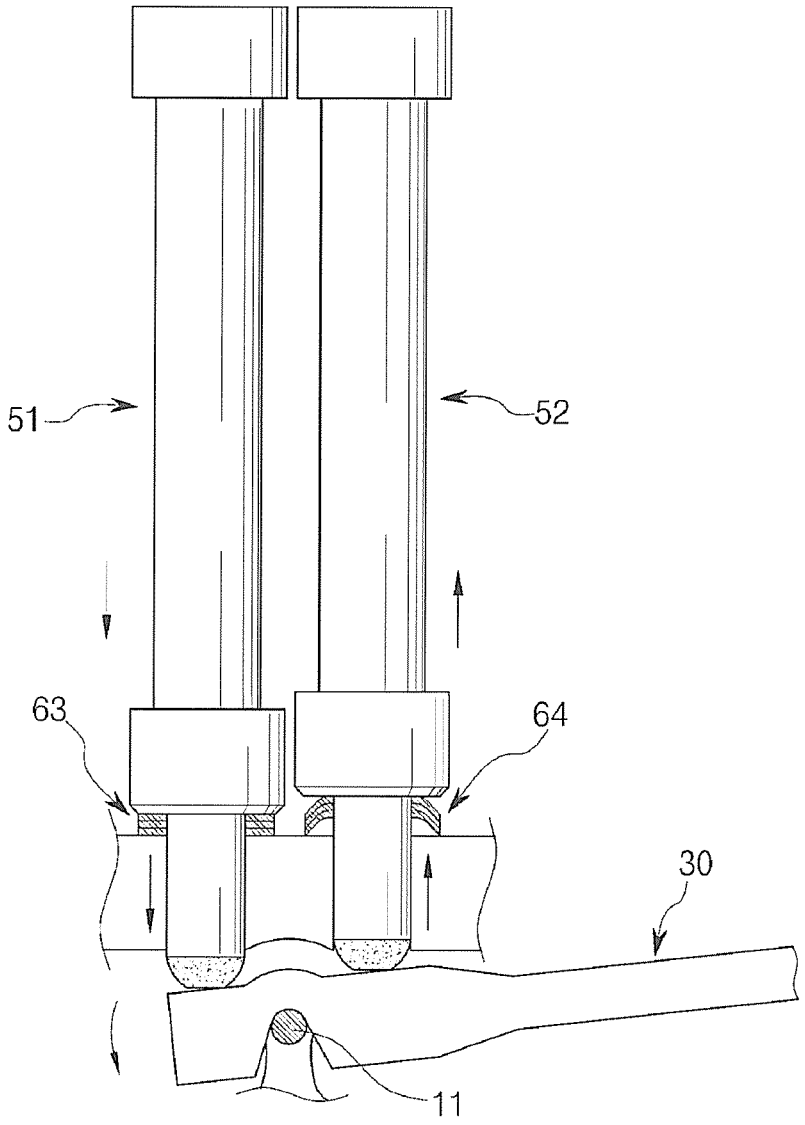

When a voltage of 100% is applied to the first piezoelectric actuator 51, and a voltage of 0% is applied to the second piezoelectric actuator 52, the first piezoelectric actuator 51 is expanded, and the second piezoelectric actuator 52 is contracted. As illustrated in FIG. 8, as the lever 30 rotates counter-clockwise, the valve rod 40 is lifted. Here, due to an operation of the second returning unit 64, rotation of the lever 30 is faster. For reference, an inclination angle of the lever 30 is exaggerated in FIG. 8 for effective description.

Figure 9:
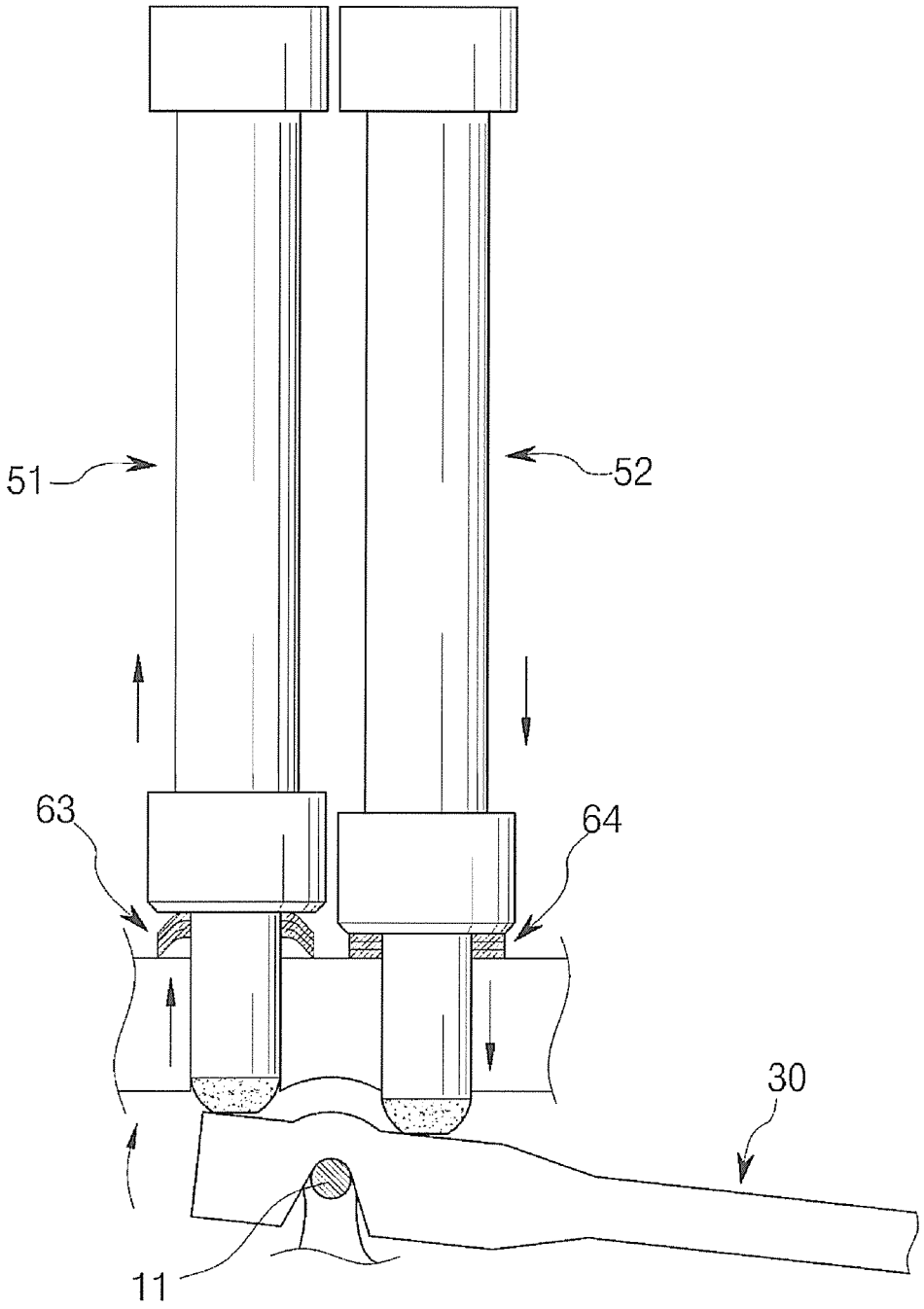

In this state, when a voltage of 0% is applied to the first piezoelectric actuator 51, and a voltage of 100% is applied to the second piezoelectric actuator 52, the first piezoelectric actuator 51 is contracted, and the second piezoelectric actuator 52 is expanded. As illustrated in FIG. 9, as the lever 30 rotates clockwise, the valve rod 40 is lowered. As the valve rod 40 inserted into the storing unit 22 is lowered, the valve rod 40 pressurizes the liquid in the storing unit 22 to discharge the liquid to the outside through the nozzle 23, thereby dispensing the liquid. Here also, the first returning unit 63 contracts the first piezoelectric actuator 51 that is adjacent thereto to help the lever 30 rotate quickly in a clockwise direction. Like FIG. 8, an inclination angle of the lever 30 is exaggerated in FIG. 9 for effective description.

By alternately applying a voltage to the first piezoelectric actuator 51 and the second piezoelectric actuator 52 as described above, the valve rod 40 is repeatedly lifted as illustrated in FIGS. 8 and 9, thereby continuously dispensing the liquid through the nozzle 23.

As illustrated in FIG. 4, a distance between a rotational axis and the valve rod 40 is far greater than a distance between the rotational axis and the first piezoelectric actuator 51 and the second piezoelectric actuator 52, and thus, a deformation amount of the piezoelectric actuators 51 and 52 may be sufficiently extended by using the lever 30 so as to operate the valve rod 40 within a sufficient height range.

The control unit 200 controlling operations of the first piezoelectric actuator 51 and the second piezoelectric actuator 52 may apply a voltage having various pulse waveforms to the first piezoelectric actuator 51 and the second piezoelectric actuator 52 according to time to thereby control dynamic characteristics of the valve rod 40. In particular, by disposing the two piezoelectric actuators 51 and 52 with the hinge axis 11 included therebetween and configuring the two piezoelectric actuators 51 and 52 to respectively operate the lever 30, not only descending movement but also elevation of the valve rod 40 may be controlled, and accordingly, the liquid may be quickly dispensed, and an amount of the dispensed liquid may also be accurately controlled.

In particular, mechanical operating characteristics of the first piezoelectric actuator 51 and the second piezoelectric actuator 52 may be accurately controlled by the control unit 200 by using an electrical method based on factors such as amplitude of a voltage to be applied, an alternating frequency of a voltage, or a deformation amount of a voltage according to time. Improvement of controlling performance with respect to an operation of the valve rod 40 as above allow easy and accurate controlling of dispensing characteristics of the dispensed liquid.

Due to characteristics of the piezoelectric actuators 51 and 52, a relatively large amount of heat is generated in the piezoelectric actuators 51 and 52 during use thereof. When a temperature of the piezoelectric actuators 51 and 52 is increased due to heat generated in the piezoelectric actuators 51 and 52, operating characteristics thereof may be degraded. In the piezoelectric pump 100 according to the present embodiment, the cooling lines 71, 72, 73, and 74 are formed in the pump body 10 as illustrated in FIG. 5. By cooling the pump body 10 through the cooling lines 71, 72, 73, and 74, an increase in a temperature of the piezoelectric actuators 51 and 52 may be prevented. When the temperature of the piezoelectric actuators 51 and 52 is increased, piezoelectric characteristics thereof are changed and an actuation displacement of the piezoelectric actuators 51 and 52 with respect to a voltage applied to the piezoelectric actuators 51 and 52 is changed, resulting in a change of an ejection amount of a liquid discharged according to an operation of a lever. As described above, when the temperature of the piezoelectric actuators 51 and 52 is increased, the piezoelectric pump 100 may not dispense an accurate amount of liquid.

Figure 6:
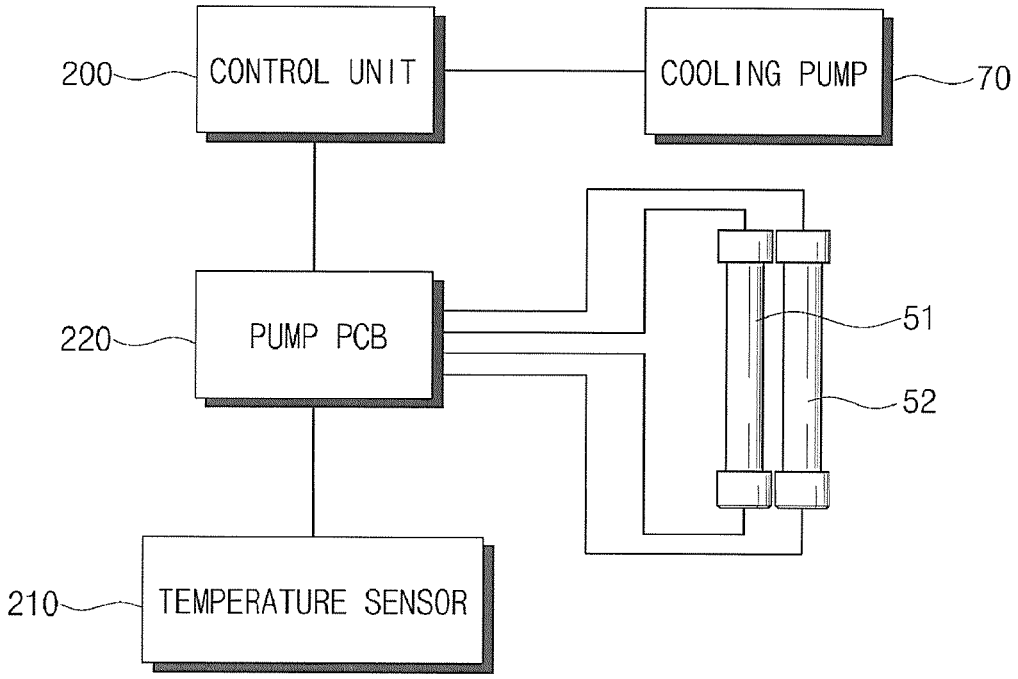
FIG. 6 is a block diagram illustrating major elements of the temperature-sensing piezoelectric dispenser illustrated in FIG. 1.

The temperature-sensing piezoelectric dispenser according to the present embodiment measures a temperature of the piezoelectric actuators 51 and 52 by using the temperature sensor 210 as illustrated in FIGS. 4 and 6, and transmits the temperature to the control unit 200. When the temperature of the piezoelectric actuators 51 and 52 is increased beyond a preset range, the control unit 200 operates the cooling pump 70 to increase a flow of air supplied to the cooling lines 71, 72, 73, and 74. The control unit 200 may control the cooling pump 70 such that the temperature of the piezoelectric actuators 51 and 52 is close to a preset temperature or may set a temperature range (for example, 27° C. to 30° C.) and control the cooling pump 70 such that the temperature of the piezoelectric actuators 51 and 52 is maintained with the set temperature range.

Also, by preventing an increase in the temperature of the piezoelectric actuators 51 and 52 as described above, dynamic characteristics of the valve rod 40 may be uniformly maintained and a dispensing quality of the liquid may be maintained. At the same time, the lifetime of the piezoelectric actuators 51 and 52 may be increased.

Meanwhile, the control unit 200 may control the piezoelectric pump 100 based on previously stored dynamic characteristics of the piezoelectric actuators 51 and 52 according to temperature of the piezoelectric actuators 51 and 52. Actuation displacement of the piezoelectric actuators 51 and 52 may vary according to temperature even when an identical voltage is applied to the piezoelectric actuators 51 and 52. The control unit 200 may control the piezoelectric pump 100 by considering a variation in the actuation displacement of the piezoelectric actuators 51 and 52 according to temperature. The actuation displacement of the piezoelectric actuators 51 and 52 may be maintained uniform even though the temperature of the piezoelectric actuators 51 and 52 is changed as the control unit 200 adjusts a voltage, a waveform or a frequency of a current or the like applied to the piezoelectric actuators 51 and 52, based on the temperature of the piezoelectric actuators 51 and 52 sensed by using the temperature sensor 210. Accordingly, an ejection amount of the liquid discharged through the nozzle may be uniformly maintained.

According to the piezoelectric pump 100 according to the present embodiment, as the pump body 10 and the valve body 20 are detachably configured and the lever 30 and the valve rod 40 are configured to be easily connected and separated to and from each other, maintenance and cleaning are easy and the piezoelectric pump 100 may be easily configured to correspond to various characteristics of a liquid. The valve body 20 and the valve rod 40 may be easily separated from the pump body 10 by loosening a screw coupling the pump body 10 and the valve body 20 and detaching the engaging rod 41 of the valve rod 40 from the engaging groove 31 of the lever 30.

When the valve body 20 is separated, it is easy to clean for next use. Even when the valve body 20 or the valve rod 40 is damaged, the valve body 20 or the valve rod 40 may be separated by using the above-described method and a new valve body 20 or a new valve rod 40 may be replaced.

When a type of a liquid to be dispensed is changed, the piezoelectric pump 100 may be configured by replacing with another valve body 20 and another valve rod that are designed in consideration of a viscosity or other characteristics of the changed liquid.

The piezoelectric actuators 51 and 52 are typically formed of a ceramic material. When the piezoelectric actuators 51 and 52 are used for a long period of time, expansion displacement thereof according to an applied voltage may be changed from the initial expansion displacement due to the characteristics of the ceramic material. Also in this case, the piezoelectric pump 100 according to the present embodiment may maintain dynamic characteristics of the lever 30 and the valve rod 40 by adjusting positions of the first piezoelectric actuator 51 and the second piezoelectric actuator 52 by using the first adjustment unit 61 and the second adjustment unit 62.

MODE OF THE INVENTIVE CONCEPT

While the inventive concept has been particularly shown and described with reference to exemplary embodiments thereof, the scope of the inventive concept is not limited to the forms described and illustrated above.

For example, while the first returning unit 63 and the second returning unit 64 that are formed of springs or implemented using a pneumatic pressure are described above, according to circumstances, a liquid pressure may be used to implement a first returning unit and a second returning unit. Also, a pump that does not include the first returning unit and the second returning unit may be included.

Also, while air is described above as a cooling fluid flowing through the cooling lines 71, 72, 73, and 74 of the pump body 10, liquid such as cooling water or cooling oil may also be used. In this case, unlike the above-described embodiment, a temperature-sensing piezoelectric dispenser is configured such that a cooling fluid supplied through the cooling lines 71, 72, 73, and 74 is not discharged to the outside but returns to the cooling pump to circulate.

Also, while the temperature sensor 210 is described above as being installed in the piezoelectric actuators 51 and 52, according to circumstances, the temperature sensor 210 may also be installed in a portion of the pump body that is close to the piezoelectric actuators. In this case, heat generated in the piezoelectric actuators may be conducted to the pump body so that the pump body senses the increased temperature, thereby indirectly measuring a temperature of the piezoelectric actuators.

Also, while the lever 30 and the valve rod 40 are described as being connected via the engaging groove 31 of the lever 30 and the engaging rod 41 of the valve rod 40, a lever and a valve rod may also be connected by using other methods. A pump body and a valve body may not be detachably coupled to each other but may be formed as a single unit.

Figure 10:
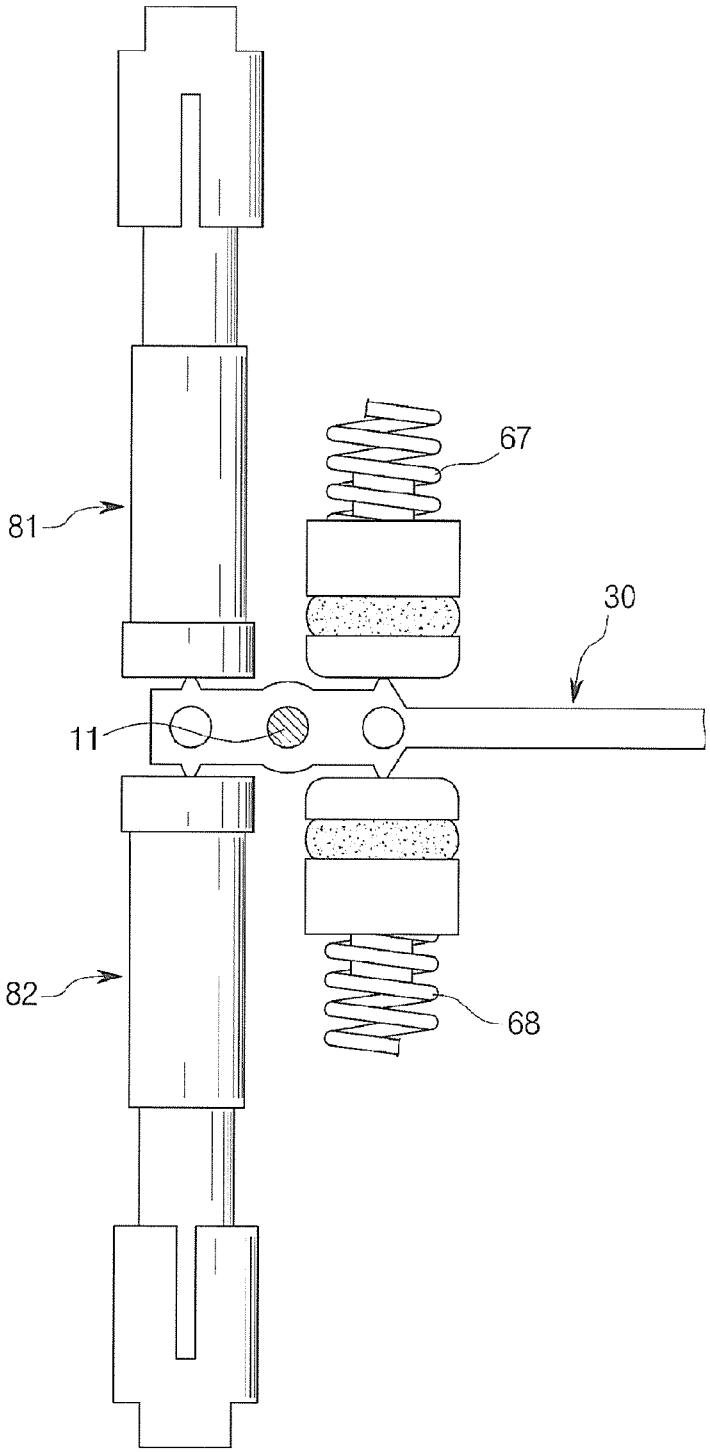
FIG. 10 is a schematic view for explaining an operation of the piezoelectric pump of the temperature-sensing piezoelectric dispenser according to another embodiment of the inventive concept.

Hereinafter, a piezoelectric pump used in a temperature-sensing piezoelectric dispenser according to another embodiment of the inventive concept will be described with reference to FIG. 10.

Unlike the piezoelectric pump of the temperature-sensing piezoelectric dispenser described above with reference to FIGS. 1 through 9, according to the piezoelectric pump of the temperature-sensing piezoelectric dispenser of the present embodiment, a first piezoelectric actuator 81 and a second piezoelectric actuator 82 are disposed to face each other in a straight line, with the lever 30 therebetween. When a voltage is applied to the first piezoelectric actuator 81, and no voltage is applied to the second piezoelectric actuator 82, the lever 30 rotates counter-clockwise to lift the valve rod 40. When no voltage is applied to the first piezoelectric actuator 81, and a voltage is applied to the second piezoelectric actuator 82, the lever 30 rotates clockwise to lower the valve rod 40, and a liquid is dispensed through the nozzle 23. A first returning unit 67 and a second returning unit 68 are also disposed to face each other in a straight line, with the lever 30 therebetween. The first returning unit 67 provides an elastic force in a direction in which the first piezoelectric actuator 81 is contracted, and the second returning unit 68 provides an elastic force in a direction in which the second piezoelectric actuator 82 is contracted.

In regard to other elements except for arrangement of the first piezoelectric actuator 81 and the second piezoelectric actuator 82, a temperature-sensing piezoelectric dispenser may be configured by appropriately modifying the other elements of the embodiments described with reference to FIGS. 1 through 9 above. However, in the piezoelectric pump according to the present embodiment, the first returning unit 67 and the second returning unit 68 may be unnecessary.

The invention claimed is:

1. A temperature-sensing piezoelectric dispenser comprising:

a pump body comprising a cooling line, through which a cooling fluid flows;

a lever that is rotatably installed with respect to a hinge axis installed in the pump body;

a first and second piezoelectric actuator installed in the pump body and each having a tip portion that is contactable to the lever as a length of the first or second piezoelectric actuator is increased when a voltage is applied to the first or second piezoelectric actuator to press and rotate the lever with respect to the hinge axis;

a valve rod that is liftably connected to the lever according to rotation of the lever;

a valve body comprising a storing unit, into which a tip portion of the valve rod is inserted and in which a liquid is stored, an inlet, through which the liquid flows into the storing unit, and a nozzle, through which the liquid of the storing unit is discharged according to advance and retreat of the valve rod with respect to the storing unit;

a temperature sensor installed in one of the first or second piezoelectric actuator and the pump body to measure a temperature;

a cooling pump for supplying the cooling fluid to the cooling line of the pump body; and a control unit for operating the first and second piezoelectric actuator and receiving the temperature sensed by using the temperature sensor to operate the cooling pump, wherein the first piezoelectric actuator and the second piezoelectric actuator rotate the lever with respect to the hinge axis in opposite directions from each other when a voltage is applied to the first piezoelectric actuator or the second piezoelectric actuator by the control unit.

2. The temperature-sensing piezoelectric dispenser of claim 1, wherein the control unit adjusts a flow of the cooling pump so that the temperature sensed by using the temperature sensor is maintained within a preset temperature range.

3. The temperature-sensing piezoelectric dispenser of claim 2, wherein the cooling fluid is one of air, water, and cooling oil.

4. The temperature-sensing piezoelectric dispenser of claim 1, wherein the control unit adjusts at least one of a voltage and a frequency of a current applied to the first or second piezoelectric actuator by considering an actuation displacement of the first or second piezoelectric actuator that is varied according to the temperature sensed by using the temperature sensor.

5. The temperature-sensing piezoelectric dispenser of claim 1, wherein the first piezoelectric actuator and the second piezoelectric actuator are disposed in parallel to each other, with the hinge axis of the pump body included therebetween.

6. The temperature-sensing piezoelectric dispenser of claim 1, wherein the first piezoelectric actuator and the second piezoelectric actuator are disposed to face each other, with the lever included therebetween.

7. The temperature-sensing piezoelectric dispenser of claim 1, further comprising:

a first returning unit for applying a force to the first piezoelectric actuator in a direction in which the first piezoelectric actuator is contracted; and a second returning unit for applying a force to the second piezoelectric actuator in a direction in which the second piezoelectric actuator is contracted.

8. The temperature-sensing piezoelectric dispenser of claim 7, wherein the first returning unit and the second returning unit are springs that are installed in the pump body and apply an elastic force to the first piezoelectric actuator and the second piezoelectric actuator.

* * * * *